US005913343A

United States Patent [19]

Andersson

[11] Patent Number: 5,913,343

[45] Date of Patent: Jun. 22, 1999

[54] VAPOR RECOVERY SYSTEM AND METHOD

[75] Inventor: Bo Göran Andersson, Salisbury, Md.

[73] Assignee: Dresser Industries, Inc., Dallas, Tex.

[21] Appl. No.: 08/907,516

[22] Filed: Aug. 8, 1997

[51] Int. Cl.[6] ..... B65B 31/00

[52] U.S. Cl. ..... 141/59; 141/45

[58] Field of Search ..... 73/30.01, 23.2, 73/23.32, 25.01, 25.04, 25.05, 30.02, 30.04; 141/290, 45, 83, 59

[56] References Cited

U.S. PATENT DOCUMENTS

| | | | |
|---|---|---|---|
| 3,607,084 | 9/1971 | Mackey | 23/232 |
| 4,098,303 | 7/1978 | Gammell . | |
| 4,197,883 | 4/1980 | Mayer . | |
| 5,038,838 | 8/1991 | Bergamni et al. | 141/59 |
| 5,244,017 | 9/1993 | Hartman et al. . | |
| 5,269,353 | 12/1993 | Nanaji | 141/59 |
| 5,280,814 | 1/1994 | Stroh . | |
| 5,378,889 | 1/1995 | Lawrence . | |
| 5,417,256 | 5/1995 | Hartsell, Jr. et al. . | |
| 5,450,883 | 9/1995 | Payne | 141/59 |
| 5,486,107 | 1/1996 | Bonne . | |
| 5,507,325 | 4/1996 | Finlayson | 141/83 |
| 5,535,614 | 7/1996 | Okamoto et al. | 73/23.31 |
| 5,592,979 | 1/1997 | Payne et al. . | |
| 5,596,972 | 1/1997 | Sultan et al. | 123/520 |
| 5,644,068 | 7/1997 | Okamoto et al. . | |
| 5,644,069 | 7/1997 | Liu et al. . | |
| 5,655,577 | 8/1997 | Loen et al. . | |
| 5,671,785 | 9/1997 | Andersson | 141/59 |

FOREIGN PATENT DOCUMENTS

| | | |
|---|---|---|
| 2226812 | 7/1990 | United Kingdom . |

*Primary Examiner*—David J. Walczak
*Attorney, Agent, or Firm*—Haynes & Boone, L.L.P.

[57] ABSTRACT

A system and method for recovering a gasoline vapor/air mixture from a vehicle tank during the dispensing of gasoline from a storage tank into the vehicle tank in which the mixture flows from the vehicle tank to the storage tank during the dispensing of the gasoline. A sensor is provided which detects a property of the mixture which corresponds to the vapor content of the mixture. The flow of the mixture is controlled in response to the vapor content of the mixture.

5 Claims, 2 Drawing Sheets

VAPOR RECOVERY SYSTEM AND METHOD

BACKGROUND OF THE INVENTION

This invention relates to a gasoline dispensing and vapor recovery system and method and, more particularly, to such a system and method for controlling the flow of a mixture of gasoline vapor and air from a vehicle fuel tank as it is being filled with gasoline.

A number of systems and methods have been proposed for controlling the flow of a mixture of air and hydrocarbon vapors (hereinafter referred to as "vapor/air mixture" displaced from a vehicle tank during the dispensing of gasoline into the vehicle tank at a service station, or the like, in order to reduce vapor emissions at the interface between the vehicle and the dispensing nozzle. In general, gasoline dispensing and vapor recovery systems and methods of this type include a plurality of dispenser housings with each housing being connected to an underground storage tank for gasoline. Each dispenser housing has one or more nozzles for dispensing the gasoline into a vehicle fuel tank, and passages are provided in each nozzle for collecting the vapor/air mixture from the vehicle tank. A return line is connected to the vapor/air mixture passage for delivering the collected vapor/air mixture back to the underground fuel storage tank.

Some of these systems and methods, often termed passive systems, rely solely upon vapor/air mixture pressure within the fuel tank to force the vapor/air mixture through the vapor/air mixture return line. However, due to pressure losses and partial obstructions in the vapor/air mixture recovery line (sometimes caused by fuel splash back or condensation), the vapor/air mixture pressure developed in the vehicle fuel tank was often insufficient to force the vapor/air mixture out of the vehicle tank and to the underground storage tank.

To eliminate this problem, "active" vapor recovery systems and methods have evolved that employ a vacuum pump for drawing the vapor/air mixture from the vehicle tank and through a vapor/air mixture return line. Some of these systems, such as the system disclosed in co-pending patent application Ser. No. 08/515,484, assigned to the assignee of the present invention, provide a relatively powerful, continuously-operating, vacuum pump and a valve arrangement for connecting the various vapor/air mixture return lines to the vacuum pump. Other active systems, such as a system marketed by the assignee of the present invention under the "WAYNE VAC" designation, employ a vacuum pump at each dispenser housing which is driven by the dispensing unit's conventional gasoline flow meter and which is connected to a vapor/air mixture return line.

Recent government-promulgated rules require, or will require, that onboard vapor recovery systems (ORVR) be installed on at least a portion of gasoline-operated vehicles. These systems are designed to capture and retain the gasoline vapors generated during refueling in an activated carbon canister located on the vehicle. The vapors captured in the canister will then be burned in the engine during normal driving.

Although the ORVR systems will render the above-mentioned vapor recovery systems unnecessary, the latter systems must remain in operation to service the vehicles not equipped with the ORVR systems. Therefore, when an ORVR-equipped vehicle is serviced, the vapor recovery systems will ingest some air to replace the fuel withdrawn from the storage tank. This upsets the dynamic equilibrium in the system and causes some of the gasoline in the storage tank to evaporate. The resulting gasoline vapors "grow" until dynamic equilibrium is regained and the mixture becomes saturated. This evaporation, or vapor growth, will often cause the volume of vapor in the storage tank to exceed the capacity of the system, and significant quantities of the gasoline vapor will be discharged into the atmosphere through a vent pipe associated with the storage tank. This reduces the efficiency of the gasoline dispensing system and pollutes the atmosphere.

Another major problem that is caused by a significant quantity of air being present in the vapor/air mixture recovered by the vapor recovery system and introduced into the storage tank, since, if a relatively small amount of gasoline vapor is in the mixture, the mixture may become flammable and cause flame propagation if a flame, or spark, is initiated, which could be disastrous. More particularly, if the percentage of vapor in the vapor/air mixture in the vapor recovery system drops to a certain level, flame propagation can occur. For example, it is well documented that, with respect to most gasolines dispensed at service stations, flame propagation can occur if the percentage of gasoline vapor in the vapor/air mixture is between approximately 2%–8%. (If the percentage of vapor is below approximately 2%, then the danger of flame propagation severely diminishes due to the lack of vapor in the mixture.)

Although there have been several techniques proposed, such as infra red light absorption, light refraction, and electrochemical sensing, for sensing or measuring the amount of vapor or air in a vapor/air mixture, these techniques suffer in several respects. For example, they are relatively expensive, bulky and/or delicate. Also, they can be unstable, unresponsive, and sensitive to environmental conditions. Further, some of these techniques require a relatively large amount of power and are relatively slow to recover after liquid saturation.

Therefore, what is needed is an active vapor recovery system and method which senses and responds to a predetermined percentage of vapor or air in the vapor/air mixture by shutting off the flow of the mixture from the vehicle. Also needed is a system and method of the above type which is relatively inexpensive, compact, rugged and stable. Also what is needed is a system and method of the above type which is not sensitive to environmental conditions and very responsive, yet enjoys low power consumption and recovers quickly after liquid saturation.

SUMMARY OF THE INVENTION

The present invention, accordingly, is a system and method for recovering a mixture of vapor and air from a vehicle tank during the dispensing of gasoline into the tank in which the above problems caused by the ingestion of too much air into the system are eliminated. More particularly, according to the system and method of the present invention, a flow line is provided for passing the vapor/air mixture from the vehicle tank to the storage tank, and a sensor is provided for sensing a property of the mixture and generating a corresponding output signal which corresponds to the amount of vapor in the mixture. A control unit is connected between the sensor and the pump for receiving the output signal and controlling the flow of the mixture through the flow line accordingly.

The system and method of the present invention enjoy the advantage of eliminating the accumulation of air in the vapor recovery system and the storage tank to the extent that it causes the problems set forth above. It is also relatively inexpensive, compact, rugged and stable while being insensitive to environmental conditions and very responsive. Further, the system enjoys low power consumption and recovers quickly after liquid saturation.

DESCRIPTION OF THE PREFERRED EMBODIMENT

Figure 1:
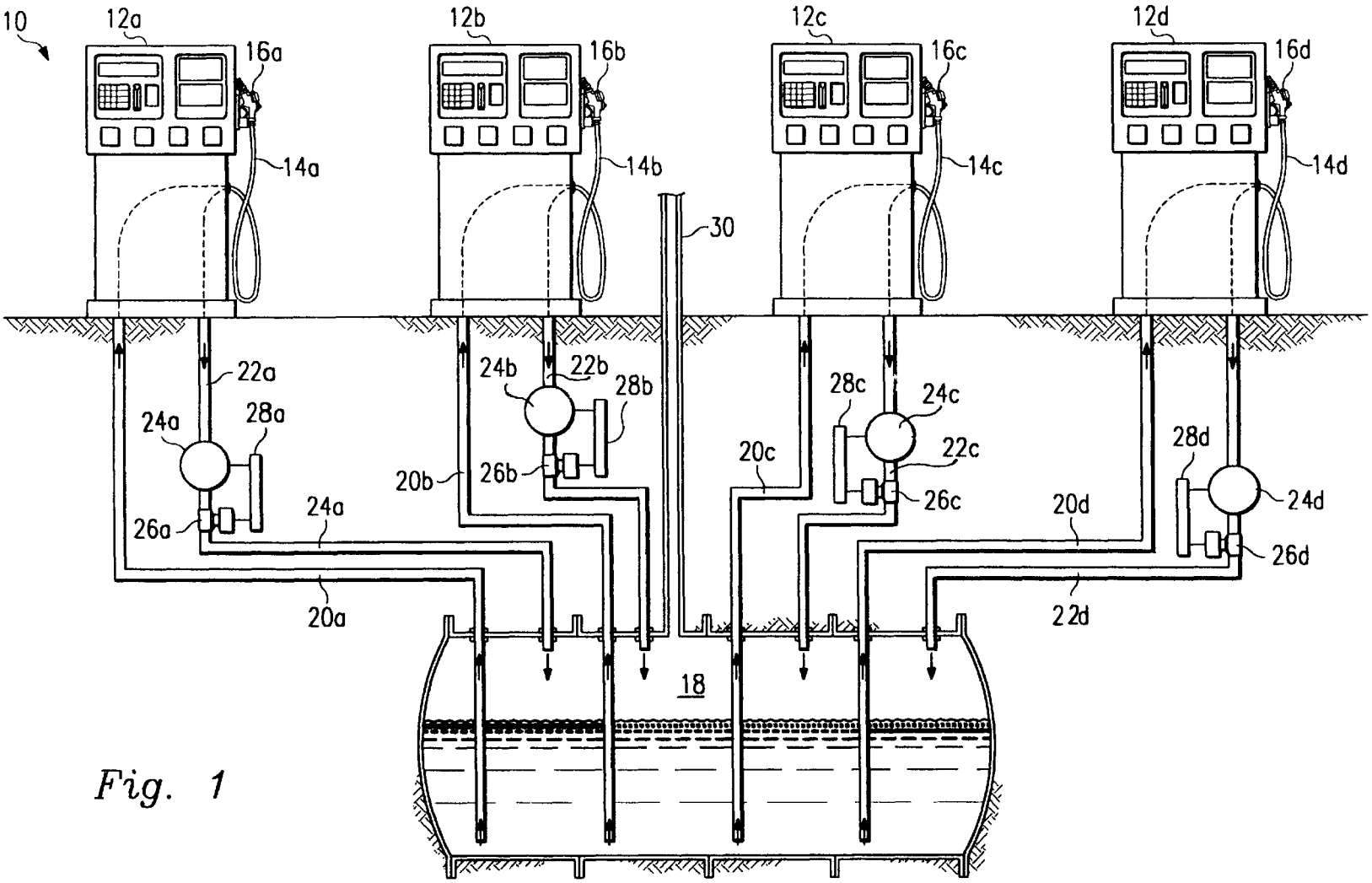
FIG. 1 is a schematic view of the system of the present invention.

Referring to FIG. 1 of the drawings, the reference numeral 10 refers, in general, to a service station installation for dispensing gasoline to vehicles. To this end, four dispenser housings 12*a*–12*d* are provided which are respectively provided with hose assemblies 14*a*–14*d* which, in turn, have dispensing nozzles 16*a*–16*d*, respectively, affixed to one end thereof.

An underground gasoline storage tank 18 is provided immediately below the dispenser housings 12*a*–12*d* and is connected by four conduits 20*a*–20*d* to the dispenser housings 12*a*–12*d*, respectively. Although not shown in the drawings for the convenience of presentation, it is understood that one or more pumps and flow meters are associated with the conduits 20*a*–20*d* for pumping the gasoline to the dispenser housings 12*a*–12*d* and for metering the flow of the gasoline, respectively. The conduits 20*a*–20*d* are connected to the hose assemblies 14*a*–14*d* in the interior of the dispenser housings 12*a*–12*d* for passing the fuel to the dispensing nozzles 16*a*–16*d*, respectively, for discharging the gasoline into the fuel tanks of vehicles being serviced.

It is also understood that each hose assembly 14*a*–14*d* includes two hoses connected to their respective dispensing nozzles 16*a*–16*d* for respectively dispensing the gasoline through one of the hoses and for receiving the displaced vapor/air mixture from the vehicle tank in the other hose, as will be described.

Four vapor recovery conduits 22*a*–22*d* extend from the hoses 14*a*–14*d*, respectively, to the underground storage tank 18 for passing the recovered mixture to the tank. Four vacuum pumps 24*a*–24*d*, are connected to the vapor recovery conduits 22*a*–22*d*, respectively for drawing the vapor/air mixture from the vehicle tanks through the nozzles 16*a*–16*d* and the hoses 14*a*–14*d*, respectively. It is understood that a master switch, or the like, is provided on each dispenser housing 12*a*–12*d* which, when actuated preparatory to dispensing gasoline into the vehicle tank to be serviced, actuates the gasoline pumps (not shown) associated with each conduit 20*a*–20*d*, respectively. The resulting gasoline flow causes the vacuum pumps 24*a*–24*d* to pump a mixture of gasoline vapor and air from the vehicle which is proportional to the gasoline flow, as disclosed in the above-identified WAYNE VAC system. Since these types of switches and controllers are well known, they are not shown and will not be described in detail.

Four sensors 26*a*–26*d* are connected in the vapor recovery conduits 22*a*–22*d*, respectively, just downstream of the corresponding vacuum pumps 24*a*–24*d* for sensing the thermal conductivity of the mixture recovered from the vehicle tank and flowing through the conduits 22*a*–22*d*. The sensors 26*a*–26*d*are conventional and manufactured by the Micro Switch division of Honeywell, Inc. of Freeport, Ill. Four control boards 28*a*–28*d* are electrically connected between the sensors 26*a*–26*d* and the vacuum pumps 24*a*–24*d* respectively. The control boards 28*a*–28*d* contain electronics, including programmable microprocessors, that respond to signals received from their respective sensors 26*a*–26*d* and control the operation of the vacuum pumps 24*a*–24*d* accordingly. Therefore, the vacuum pumps 24*a*–24*d* are normally switched on when the operator starts dispensing the gasoline at the dispenser housing, and are switched off in response to a predetermined signal received from the control boards 28*a*–28*d*, respectively.

A vent pipe 30 extends from the underground storage tank 18 to a height above ground for the purpose of venting the latter tank when the fluid pressure in the tank exceeds a predetermined value, as will be explained.

Figure 2:
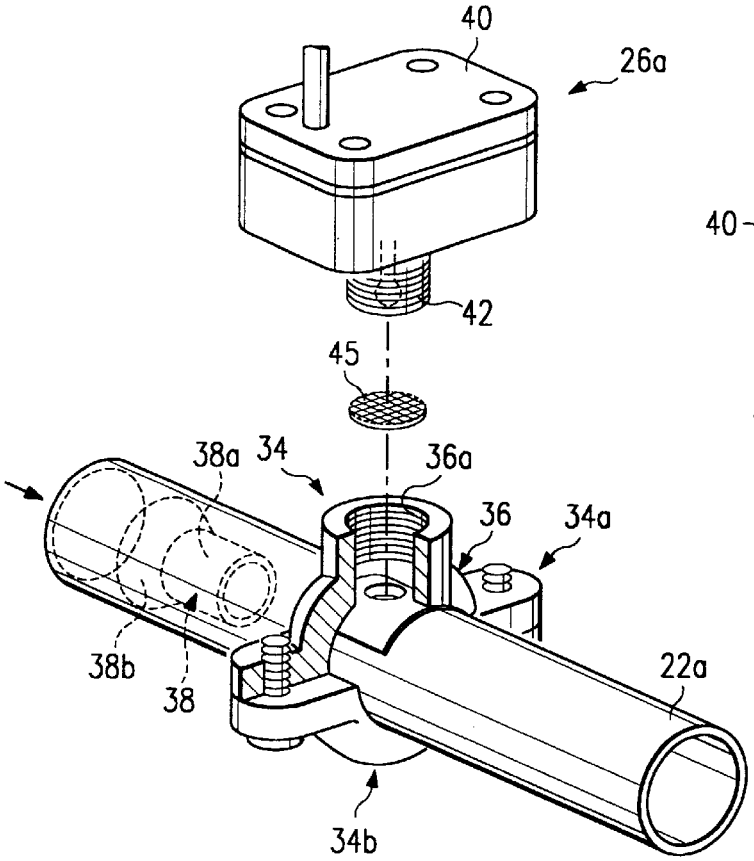
FIG. 2 is an enlarged, exploded isometric view of the sensor and a vapor return conduit of the system of FIG. 1.
Figure 3:
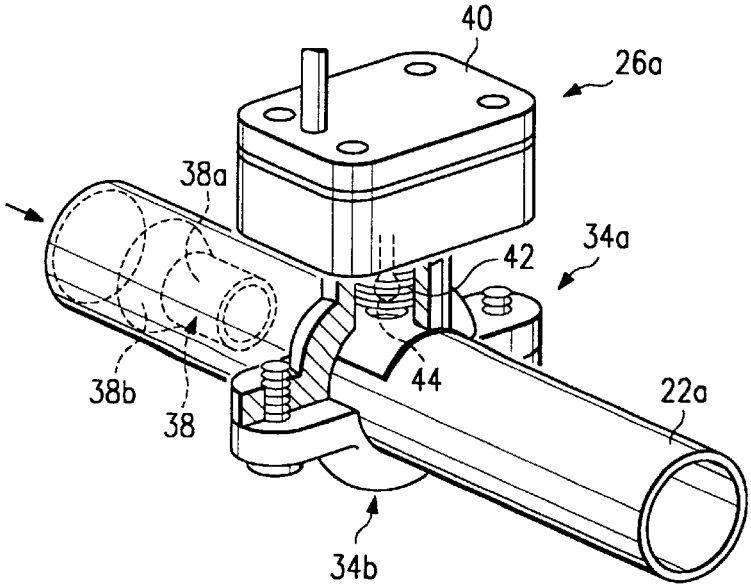
FIG. 3 is a view similar to FIG. 2, but depicting the sensor assembled to the conduit.

The details of the sensor 26*a*, and its connection to the conduit 22*a*, are shown in FIGS. 2 and 3, it being understood that the other sensors 26*b*–26*d* are identical and are connected to their respective conduits 22*b*–22*d* in the same manner. More particularly, a clamp assembly 34 connects the sensor 26*a* to the conduit 22*a* and includes an upper member 34*a* and a lower member 34*b* which together extend around the outer circumference of a selected section of the conduit 22*a*.

The upper clamp member 34*a* is formed by a body member 36 having a threaded bore 36*a* (FIG. 2) extending therethrough. The clamping assembly 34 will not be described in any further detail since it does not form any part of the present invention and since it is fully disclosed in applicant's co-pending application serial number (attorney's docket number 5528.112), also assigned to the assignee of the present application.

It is understood that a hole is drilled through the conduit 22*a* in axial alignment with the bore 36*a* in the body member 36. This hole can be drilled in any known manner including the technique disclosed in the above-identified patent application.

A restrictor 38 is disposed in the conduits 22*a*–22*d* just upstream of the sensors 26*a*–26*d*, respectively. As shown in connection with the conduit 22*a* in FIGS. 2 and 3 for example, the restrictor 38 consist of a tube 38*a* coaxially disposed in the conduit 22*a* and having a diameter less than that of the conduit. An annular flange 38*b* extends radially outwardly from the upstream end of the tube 38*a* and is fastened to the inner wall of the conduit 22*a* in any know manner.

As the vapor/air mixture flows from the pump 22*a* to the tank 18 it passes through the restrictor 38 just before it passes by the sensor 26*a*. The restrictor functions to increase the velocity of the vapor/air mixture flowing past the sensor 26*a* so that any liquids and solid particles, such as dirt, sediment, etc. in the mixture are propelled past the sensor 26*a*. Therefore, the sensor 26*a* will be exposed primarily to the vapor/air mixture to insure accurate sensing. It is understood that a restrictor identical to the restrictor 38 is disposed in each of the conduits 22*b*–22*d* just upstream of their respective sensors 26*b*–26*d* and function identically to the restrictor.

The sensor 26*a* includes a housing 40 in which electrical components (not shown) used in the sensing operation are disposed. A threaded sleeve 42 projects downwardly from the housing 40 as viewed in FIG. 2, and can be formed integrally with the housing or attached to the housing in any known manner. The sleeve 42 is sized so that it threadedly engages the bore 36*a* of the body member 36 to secure the housing 40 to the clamp assembly 34.

Figure 4:
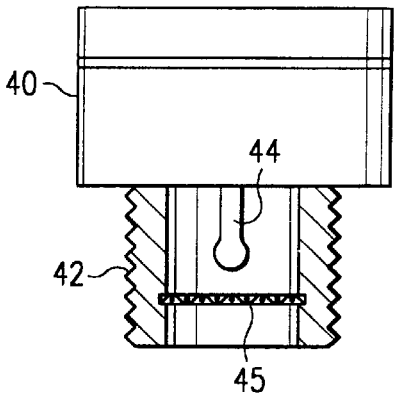
FIG. 4 is an enlarged view of a portion of the assembled sensor and conduit of FIG. 3.

As better shown in FIG. 4, a probe 44 extends from the housing 40 and into an axial bore extending through the length of the sleeve 42. A membrane separator 45 is disposed in the sleeve and extends just below the probe 44, as viewed in FIGS. 2 and 3. The separator 45 functions in a conventional matter to filter out solid particles and liquid from the vapor/air mixture passing through the membrane. For example, the separator 45 can be in the form of a hydrophobic nylon membrane which repels low surface-tension liquids while venting gases.

In the assembled condition shown in FIG. 3, the membrane 45 extends just above the above-mentioned opening in the conduit 22*a*, and the probe 44 extends just above the membrane. As a result, some of the vapor/air mixture flowing through the conduit 22*a* passes into the sleeve 42, through the membrane 45, and over the probe 44. It is understood that the probe 44 is adapted to sense, or measure, the thermal conductivity of the vapor/air mixture in a conventional manner. It is also understood that the sensor housing 40 contains electronics for responding to the output of the probe 44 and for generating an output signal whose frequency varies in response to changes in the thermal conductivity of the mixture. The output signal is passed to the control board 28*a* for processing the signal and controlling the vacuum pump 24*a*, in a manner to be described.

Since the air in the mixture has a higher thermal conductivity than the vapor the system can be designed to terminate the vapor recovery in response to the thermal conductivity of mixture, as sensed by the sensors 26*a*–26*d*, respectively rising above a threshold value. More particularly, the sensors 26*a*–26*d* can be selected and designed to output a signal whose frequency varies with the thermal conductivity of the mixture. The control boards 28*a*–28*d* receive the frequency signals from their corresponding sensors 26*a*–26*b* and are programmed to generate an output signal that switches off their respective vacuum pumps 24*a*–24*d* in response to a frequency signal rising above a predetermined, relatively high, value that corresponds to a very high percentage of air, such as above 92% and a corresponding, relatively low, value of vapor, such as 8%, in the mixture.

In operation, and assuming that a vehicle is to be serviced by the dispenser housing 12*a*, the nozzle 16*a* is inserted into the vehicle tank and actuated, causing gasoline to flow from the storage tank 18, through the conduit 20*a* and one of the hoses in the hose assembly 14*a*, to the nozzle 16*a*, and into the vehicle tank. Actuation of the nozzle 16*a* initiates the fuel flow which, in turn, activates the vacuum pump 24*a* as described above, with the pump drawing a mixture of gasoline vapor and air from the tank and into the conduit 22*a*.

As the vapor/air mixture flows through the conduit 22*a* from the vehicle tank to the storage tank 18, the thermal conductivity of the mixture is sensed by the sensor 26*a* in the manner described above, and the sensor generates an output signal whose frequency varies with variations in the thermal conductivity of the mixture flowing through the conduit 22*a*. If the vehicle being serviced is not equipped with an ORVR (described above), then the thermal conductivity of the mixture is relatively low indicating that the percentage of vapor in the mixture is relatively high and in equilibrium with the vapor/air mixture in the storage tank 18. Therefore the amount of vapor in the mixture is not low enough to cause the mixture to be flammable or to cause evaporation, or vapor growth, in the storage tank 18 of a magnitude sufficient to over-pressurize the tank and cause an undue amount of discharge of the mixture into the atmosphere through the vent pipe 30, as discussed above. Thus, in these cases, the frequency of the output signal from the sensor 26*a* would not rise above the above predetermined threshold value. Therefore, the control board 28*a* would maintain the pump 24*a* in its operable condition.

However, if the percentage of vapor in the mixture is significantly lower, such as when the vehicle is equipped with an ORVR as described above, the thermal conductivity of the mixture per unit volume will increase. This causes a corresponding increase in the frequency of the output signal from the sensor 26*a* to the control board 28*a*. If the thermal conductivity of the mixture increases above the above-mentioned threshold value, indicating a vapor percentage below its threshold value, the sensor 26*a* will generate a signal having a corresponding relatively high frequency. The control board 28*a* responds to the latter high-frequency signal from the sensor 26*a*, and switches off the vacuum pump 24*a*. Thus, the vacuum pump 24*a* is shut off when the percentage of vapor in the mixture drops to a level that would cause the vapor/air mixture to be flammable and/or causes the vapor to be out of equilibrium with the mixture in the storage tank 18 such that excessive evaporation, or vapor growth, occurs.

Of course, after the nozzle 16*a* is returned to the dispenser housing 12*a*, the gasoline pump, the vacuum pump 24*a*, and the sensor 26*a* are all reset for the next vehicle to be serviced. It is understood that the sensors 26*b*–26*d* and the control boards 28*b*–28*d* control the operation of the vacuum pumps 24*b*–24*d* in an identical manner.

As a result of the above, the system and method of the present invention enjoy several advantages. For example, the accumulation of unacceptable amounts of air in the vapor recovery system is eliminated. Thus, excessive evaporation, or vapor growth, is eliminated thus preventing the storage tank from becoming over-pressurized and eliminating the discharge of unacceptable amounts of gasoline vapor into the atmosphere. Also, the possibility of a hazardous mixture of oxygen and gasoline vapors accumulating in the underground storage tank is eliminated. Further, the system of the present invention is relatively inexpensive, compact, rugged and stable. Also, it is insensitive to environmental conditions and very responsive, yet enjoys low power consumption and recovers quickly after liquid saturation. Also, the disposition of the sensors downstream of their respective vacuum pumps insures that there is no submersion by gasoline buildup upstream of the pump when the system is idle. Further, the use of frequency signals facilitates diagnostic testing.

According to alternative embodiments of the system and method of the present invention the sensors 26*a*–26*d* can be selected and designed to respond to other parameters of the vapor/air mixture that correspond to the vapor content of the mixture. For example, since the air in the mixture is less dense than the vapor in the mixture, the system can be designed to terminate the vapor recovery in response to the density of mixture, as sensed by the sensors 26*a*–26*d*, respectively falling below a threshold value. For example, assuming that the average molecular weight of the vapor/air mixture recovered from the vehicle tank and flowing through the conduits 22*a*–22*d* is 65 grams/mole, the density of the mixture would vary between 1.60 and 2.30 kilograms/cubic meter. Since the density of pure air is less than that of the mixture and usually varies between 0.98and 1.53 kilograms/cubic meter, the density of the mixture will fall below the 1.60 kilograms/cubic meter value when all or a great majority of the mixture consists of air. Therefore, the control boards 28*a*–28*d* are programmed to respond to a frequency signal received from their corresponding sensors 26*a*–26*d* falling below a value that corresponds to a density of 1.60 kilograms/cubic meter and generate an output signal that switches off their respective vacuum pumps 24*a*–24*d*.

As another example of the parameters of the vapor/air mixture that can be sensed, the sensor disclosed and claimed in U.S. Pat. No. 5,378,889 can be used which includes an absorber-expander coupled to an optical fiber to produce a change in transmission of light along the fiber upon absorption of hydrocarbon which, as applied to the present invention, would be the hydrocarbons in the gasoline vapor. The disclosure of this patent is incorporated by reference.

Also, the sensor can directly detect the presence (and absence) of saturated gasoline vapors in the vapor/air mixture. To this end a vapor sensor marketed under the trademark ADSISTOR by Adsistor Technology, Inc. of Seattle, Wash. includes a sensor formed by a polymer-coated resistor whose conductively changes in the presence of gasoline vapor as a result of absorption of the hydrocarbons in the gasoline vapor by the polymer. A control circuit produces a predetermined output signal when saturated gasoline vapors are in the vapor/air mixture and a signal of a different magnitude when at least a substantial portion of the mixture is air.

Another alternative embodiment would incorporate an acoustic sensor that senses variations in the speed of sound through the mixture, such as a sensor built by Alicat Scientific, Inc. of Tucson, Ariz. Since it is well documented that sound passes through air faster than though gasoline vapor, the system can be calibrated to shut off the vacuum pumps 24*a*–24*d* when the speed of the sound through the mixture, as sensed by the above sensor, exceeds a threshold value corresponding to the vapor content of the mixture falling below the predetermined threshold value.

Another embodiment would incorporate sensors that sense the electrical conductivity of the mixture and produce corresponding output signals. Since the electrical conductivity of the air is different from that of the vapor in the mixture, the system can be calibrated to shut off the vacuum pumps 24*a*–24*d* when the electrical conductivity of the mixture reaches a threshold value corresponding to the vapor content of the mixture falling below the predetermined threshold value.

Similarly, other properties of the gasoline vapor/air mixture can be sensed and corresponding output signals generated to control the operation of the vacuum pumps 24*a*–24*d* accordingly. For example, a sensor, such as one built by Research International of Woodinville, Wash. is designed so that its spectral reflectance (color) changes as the hydrocarbon content of the mixture changes and so that it can be remotely interrogated via an optical fiber. Thus it could sense variations in the hydrocarbon content of the vapor/air mixture and generate a corresponding output signal corresponding to the vapor content of the mixture, which would be utilized as described above.

Still other sensors could be provided within the scope of the present invention. For example, sensors could be used that sense light absorption, radioactive absorption, or a chemical reaction of the mixture and produce output signals corresponding to the vapor content of the mixture, as discussed above.

It is understood that these alternate embodiments incorporating different sensors discussed above are otherwise identical to the first embodiment and thus also enjoy the same advantages.

It is understood that several variations may be made in the foregoing without departing from the scope of the invention. For example, the sensors can be connected to other types of flow control members such as valves, etc., for controlling the flow of the mixture in response to a predetermined value of the thermal conductivity of the mixture. Also, the sensors are not limited to producing an output signal whose frequency varies with variation in the parameter sensed. Further, the relative location between the restrictor and the sensor can vary. Further, the present invention is not limited to shutting off the vacuum pump, or other flow control member, when the vapor content of the mixture falls below a predetermined value, but rather can be programmed to cut off the vacuum pump in response to a predetermined rate of change of the percentage of vapor in the vapor/air mixture.

Also, the system of the present invention can be programmed to reduce the pumping action of the vacuum pumps, or the position of the flow control valve, rather than shut them off, in response to the vapor content of the vapor/air mixture falling below a predetermined value. Further, an alarm can be activated in response to the latter condition, and flow-inducing members other than vacuum pumps can be used to induce the flow of the vapor/air mixture from the vehicle tank to the storage tank. Also, the vacuum pumps, or other flow control members, can be in a location in the system of the present invention other than the location described above. Further, the sensors do not have to be connected in the conduits 22*a*–22*d*, respectively, but can be located in the nozzles 16*a*–16*d*, the hose assemblies 14*a*–14*d*, the vacuum pumps 24*a*–24*d*, or the tank 18. Also, only one control board can be provided for the system of the present invention which would be electrically connected to all of the sensors 26*a*–26*d* for controlling the vacuum pumps 24*a*–24*d*. Further, the housing 40 can be formed integrally with the body member 36.

Also, although the terms "conduit," "hose," "tube", and "pipes" have been used above, it is understood that these terms can be used interchangeably and can be in the form of any type of flow line that permits the flow of the gasoline and the vapor/air mixture. Further, more than one underground storage tank, similar to the tank 18, can be provided for storing different grades of gasoline and a blending chamber, or valve, can be included to regulate the volumetric ratio of relative low octane products, such as unleaded regular, and relatively high octane products, such as unleaded premiums, so as to make available multiple grades of fuel. Of course, the number of vacuum pumps used in the system of the present invention can vary within the scope of the invention.

Still other modifications, changes and substitutions are intended in the foregoing disclosure and in some instances some features of the invention will be employed without a corresponding use of other features. Accordingly, it is appropriate that the appended claims are construed broadly and in a manner consistent with the scope of the invention.

What is claimed is:

1. A system for recovering a gasoline vapor/air mixture from a vehicle tank during the dispensing of gasoline from a storage tank into the vehicle tank, the system comprising a flow line connecting the vehicle tank to the storage tank for permitting the mixture to flow from the vehicle tank to the storage tank; a pump for pumping mixture through the flow line and varying the flow of the mixture through the flow line; a sensor disposed in the flow line downstream of the pump for sensing the density the mixture and generating a corresponding output signal the frequency of which is proportional to the density of the mixture and therefore the vapor content of the mixture; and a control unit for receiving the output signal and for switching off the pump, and therefore the flow of the mixture through the flow line, in response to the vapor content of the mixture attaining a predetermined value.

2. The system of claim 1 further comprising a nozzle assembly for dispensing the gasoline into the vehicle tank and receiving the mixture from the vehicle tank, the flow line connecting the nozzle assembly to the storage tank for permitting the mixture to flow from the nozzle assembly to the storage tank.

3. A system for recovering a gasoline vapor/air mixture from a vehicle tank during the dispensing of gasoline from a storage tank into the vehicle tank, the system comprising a flow line connecting the vehicle tank to the storage tank for permitting the mixture to flow from the vehicle tank to the storage tank; a pump for pumping the mixture through the flow line; a housing connected to the flow line; a sensor disposed in the housing out of the flow path of the mixture through the flow line for sensing a property of the mixture corresponding to the vapor content of the mixture and generating a corresponding output signal; a restrictor disposed in the conduit upstream of the sensor for increasing the velocity of the mixture as it flows by the sensor; and a control unit for receiving the output signal and switching off the pump when the vapor content of the mixture falls below a predetermined value.

4. The system of claim 3 wherein the sensor is disposed in the flow line downstream of the pump.

5. A system for recovering a gasoline vapor/air mixture from a vehicle tank during the dispensing of gasoline from a storage tank into the vehicle tank, the system comprising a flow line connecting the vehicle tank to the storage tank for permitting the mixture to flow from the vehicle tank to the storage tank; a flow varying member for varying the flow of the mixture through the flow line; a housing connected to the flow line; a sensor disposed in the housing out of the flow path of the mixture through the flow line for sensing a property of the mixture corresponding to the vapor content of the mixture and generating a corresponding output signal; a restrictor disposed in the conduit upstream of the sensor for increasing the velocity of the mixture as it flows by the sensor; a control unit for receiving the output signal and controlling the operation of the flow varying member, and therefore the flow of the mixture through the flow line, in response to the vapor content of the mixture attaining a predetermined value; and a nozzle assembly for dispensing the gasoline into the vehicle tank and receiving the mixture from the vehicle tank; the flow line connecting the nozzle assembly to the storage tank for permitting the mixture to flow from the nozzle assembly to the storage tank.

* * * * *